United States Patent [19]

Lee et al.

[11] Patent Number: 4,549,408

[45] Date of Patent: Oct. 29, 1985

[54] CUBE ICEMAKER WITH ROTARY ICE REMOVER MEANS

[76] Inventors: Joseph M. Lee, 11223 Bonaport, Cypress, Tex. 77429; Robert C. Lane, 2030 Richmond, Houston, Tex. 77098

[21] Appl. No.: 618,687

[22] Filed: Jun. 8, 1984

[51] Int. Cl.[4] ..... F25C 5/02

[52] U.S. Cl. ..... 62/320; 62/347; 241/DIG. 17

[58] Field of Search ..... 62/320, 347, 348; 241/DIG. 17, 277

[56] References Cited

U.S. PATENT DOCUMENTS

| | | | |
|---|---|---|---|
| 2,344,922 | 3/1944 | Raver | 62/320 X |
| 2,691,277 | 10/1954 | Stair | 62/320 X |
| 2,813,403 | 11/1957 | Ostrom | 62/347 X |
| 3,403,532 | 10/1968 | Knowles | 62/347 |
| 3,863,463 | 2/1975 | Utter et al. | 62/354 |

*Primary Examiner*—William E. Tapolcai

*Attorney, Agent, or Firm*—Guy E. Matthews

[57] ABSTRACT

An icemaker for automatically and continuously producing clear ice in cubes comprising (a) a triple-walled stationary evaporator drum disposed with a plurality of equally-spaced, radially outwardly projecting ridges, (b) a rotary perforated water distribution tube overlying the evaporator drum for delivering a continuous and predetermined amount of water to the freezing surface thereof, a water pump for supplying water to the distribution tube, and a rotary, sequentially-functioning cutter assembly which coacts with the water distribution tube to break, size and remove cubes from the layer of ice formed on the freezing surface of the evaporator drum.

13 Claims, 6 Drawing Figures

CUBE ICEMAKER WITH ROTARY ICE REMOVER MEANS

BACKGROUND OF THE INVENTION

This invention relates to an improved apparatus for making clear ice in cubes. More particularly, the present invention relates to the manufacture of ice in a continuous manner upon a novel stationary evaporator drum surface and its constant removal therefrom in cubes through utilization of a novel cutter/remover means.

DESCRIPTION OF THE PRIOR ART

As far as applicant is presently aware, the prior art is as follows: U.S. Pat. Nos. Reichert et al 4,429,551; Swanson et al 3,252,299; Ostrom 2,716,331; Knowles 2,749,722; Ostrom 2,813,403; Rapson 2,883,162; Richelli 2,890,572; Davis 2,940,275; Suss 2,136,062; Gruhn 2,449,730; Lessard et al 2,585,021; Kattis 2,650,479; Lees 2,659,212; Wenzelberger 2,657,549; Lindsey 2,671,646 and Raver 2,697,919.

Prior art icemakers detail systems which are energy-inefficient, unsanitary, expensive to maintain, and/or require an inordinate amount of floor space, particularly high production icemakers.

Specifically, a number of prior art icemakers require the provision of some form of heat to the evaporator drum surface in the removal of ice therefrom. This procedure is energy-inefficient as a tremendous amount of energy is expended to freeze, heat, and refreeze the surface upon which the ice is formed.

In addition, algae tends to build up within the system when it is exposed to warm air and warm water. The system must then be shut down and treated with an algicide to remove the growth—the obvious, and unsanitary, result of exposing the system to heat. Cold water also tends to give rise to the manufacture of white, rather than clear, ice when it is again exposed to the now hot surface of the evaporator, such surface being hot due to the hot gas harvest needed to combat this problem. Certain manufacturers suggest purging the cold water from the system, and replacing it with warm supply water to prevent growth of large ice crystals which is referred to as white ice.

Still further, most high production icemakers (producers of large amounts of ice) are behemoths requiring tremendous amounts of floor space.

It is therefore an object of the present invention to provide a novel icemaking apparatus which is energy-efficient, sanitary and inexpensive to maintain.

It is another object of this invention to provide a novel icemaking apparatus which requires but a small amount of floor space.

It is yet another object of this invention to provide a novel icemaking apparatus which produces clear ice in cubes.

It is yet another object of the present invention to provide an icemaking apparatus which manufactures ice in a continuous manner upon a novel stationary evaporator drum surface and its constant removal therefrom with a novel cutter/remover means.

These and other objects and advantages of the present invention will be best understood upon a careful reading of the following detailed description taken in connection with the accompanying drawings which form a part of the specifications.

DESCRIPTION OF THE PREFERRED EMBODIMENTS

Figure 1:
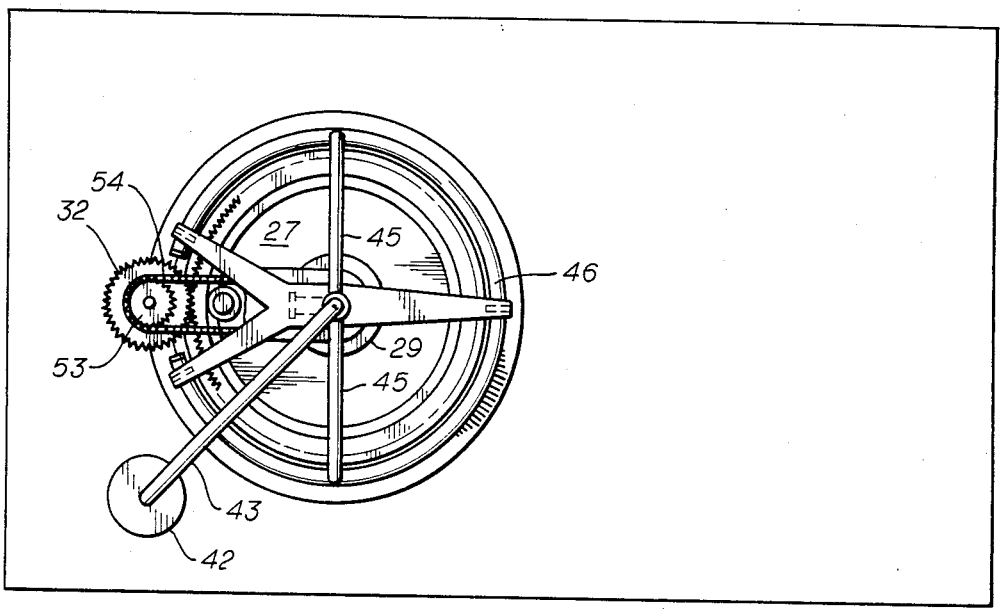
FIG. 1 is a top view of the cube ice making machine constructed in accordance with the preferred embodiment of the present invention.
Figure 3:
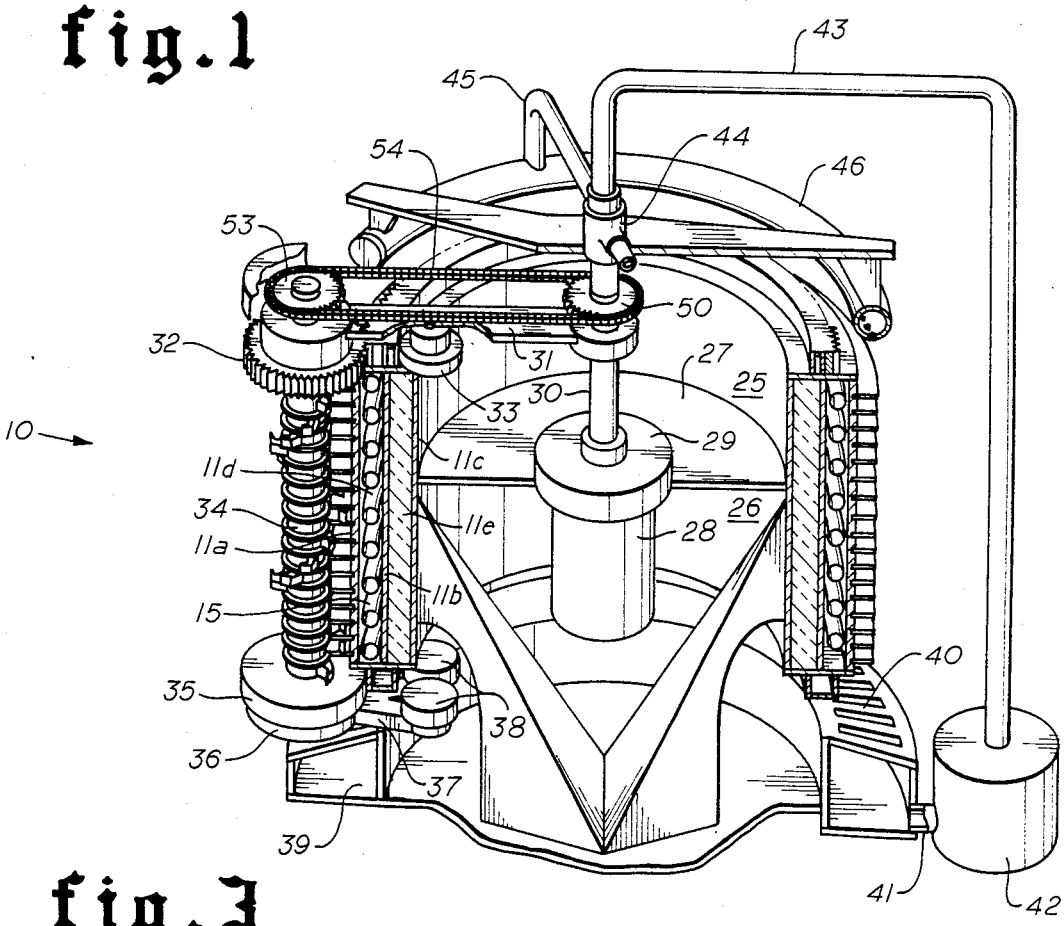
FIG. 3 is an elevational side view in cross-section illustrating the cube icemaking machine constructed in accordance with the preferred embodiment of the present invention.
Figure 2:
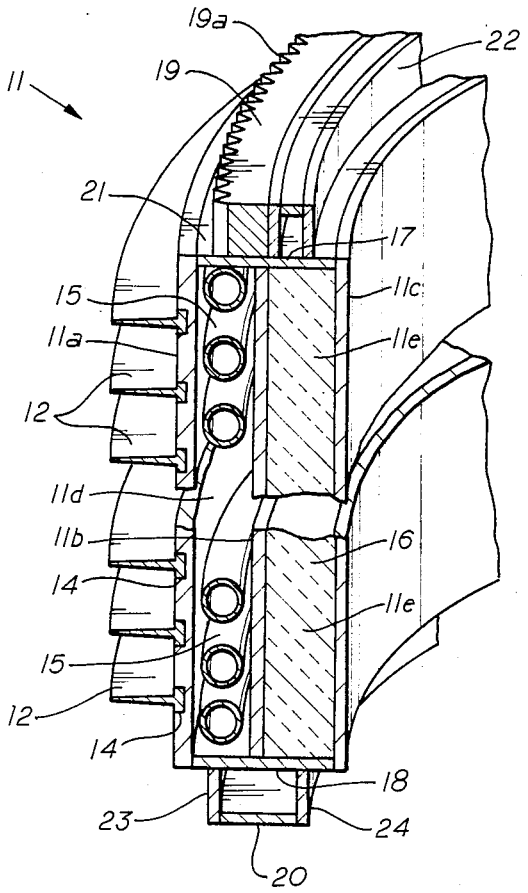
FIG. 2 is an elevational side view in cross-section showing the construction of the evaporator drum of the preferred embodiment of the present invention.
Figure 4:
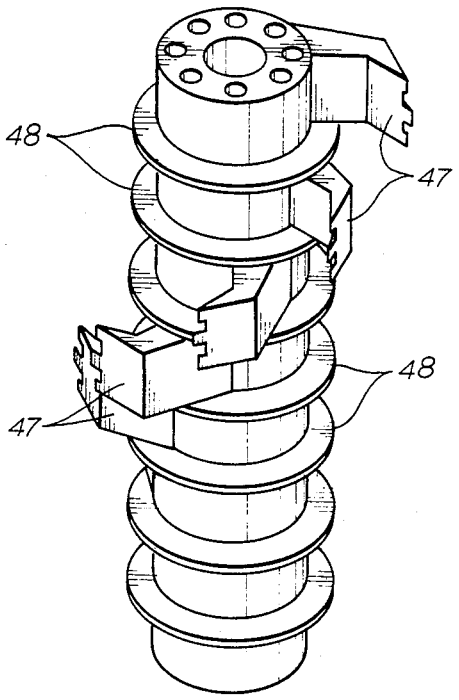
FIG. 4 is an elevational side view illustrating the ice cutter/ice removal means constructed in accordance with the preferred embodiment of the present invention.

Referring now to the drawings, and specifically to FIGS. 1–3, the reference numeral 10 designates an icemaking machine constructed in accordance with the provisions of the present invention. As shown in FIG. 2, such icemaking machine 10 details a vertically disposed, stationary evaporator drum 11 having a triple walled configuration. For purposes of clarification, the outer wall of said evaporator drum 11 will be designated as 11*a*, the middle wall as 11*b*, and the innermost wall, which defines the inner circumferential surface thereof, as 11*c*. As these three walls are spaced apart, the annular spaces disposed thereinbetween shall be designated as 11*d* and 11*e*, with 11*d* designating the outermost area, and 11*e* defining the innermost area.

The outermost or exterior wall 11*a* of the evaporator drum 11 is disposed with a plurality of radially outwardly projecting ridges 12, each encircling the entire exterior circumference of the drum 11. These radially outwardly projecting ridges 12 are appropriately connected to the exterior wall 11*a* of the drum 11 through the provision of slots 14 into which the innermost ends of the radially outwardly projecting ridges 12 are disposed. It should be understood that the exterior wall 11*a* defines the refrigerated surface upon which the ice produced herewith is to be formed.

Appropriately positioned in equally spaced relation to each other, and disposed within the area 11*b*, which is defined by the exterior wall 11*a* and the middle wall 11*b*, are a plurality of tubular evaporator coils 15 through which a refrigerant, such as freon or the like, is circulated for purposes of refrigerating the exterior wall 11*a* upon which ice is to be formed.

Situated between the middle wall 11*b* and the innermost or interior wall 11*c* of the drum 11, in the area designated as 11*e*, is a body of insulating material 16. Such insulating material serves to insulate the evaporator coils 15 and the exterior wall 11*a* from any heat which may eminate from the motor means as will be described hereinafter.

Plates 17 and 18 form the top and bottom surfaces of the triple wall evaporator drum 11 and are appropriately secured thereto to form rigid parts of the evaporator drum assembly 11. The walls 11*a*, 11*b* and 11*c* and the plates 17 and 18 are preferably made of stainless steel.

Mounted to the top of plate 17 which forms the top surface of the wall of the evaporator drum 11 is an upwardly vertically projecting, centrally located annular spine 19 which, in conjunction with the plate 17, forms an external shoulder 21 and an internal shoulder 22. For reasons as detailed hereinafter, external shoulder 21 is provided with an annular series of equally spaced driving projections or gear teeth 19*a*.

Similarly mounted to the bottom of the plate 18, which forms the bottom surface of the wall of the evaporator drum 11, is a downwardly vertically projecting, centrally located annular spine 20 which in conjunction with the plate 18 forms an external shoulder 23 and an internal shoulder 24.

Within the interior cavity 25 of the evaporator drum 11, and extending upwardly from the bottom thereof for a distance which generally approximate two-thirds of said cavity 25, is an annular housing 26 which is closed at its top through utilization of a plate 27. Such plate 27 is disposed with a centrally located aperture into which is disposed a suitable motor means 28. Connected to said motor means 28 above said plate 27 is a gear box 29, said gear box being of a larger diameter than that of the centrally located aperture plate 27 so as to hold said motor means 28 in suspension. Extending axially, vertically upwardly through said gear box 29 is a trunnion shaft 30 to which is attached a gear wheel 50 contained in a support bearing housing, and above such support bearing housing an arm 31 which extends radially outwardly beyond the outer peripheral surface of the evaporator drum 11. Connected near the terminal end of said arm 31 and extending vertically downwardly therefrom is a drive gear shaft upon which is disposed a toothed, circular drive gear 32 adapted to ride upon external shoulder 21 and cooperate with gear teeth 19*a*. As can be seen more clearly in FIG. 3, gear wheel 50 lies in the same plane as gear wheel 53, to drive the same by way of a chain 54, as explained in more detail hereinafter. Also disposed on said arm 31 and adapted to ride upon interior shoulder 22 is a radially downwardly extending shaft upon which is disposed a cooperating support bearing 33.

The drive gear shaft upon which is positioned a drive gear 32 extends through the drive gear 32 and forms the spine of the novel rotating cutter assembly 34 of the present invention which will be more fully described hereinafter. Near the terminal end of the vertically downwardly extending drive gear shaft and disposed thereupon is a T-shaped support bearing 35 so configured to prevent side motion of the shaft and adapted to ride upon exterior shoulder 23. Depending downwardly from the support bearing 35 is a housing means 36 from which radiates a pair of arms 37 to which of are attached a pair of bearing wheels 38 to ride upon interior shoulder 23.

Below the evaporator drum 11, and forming an annulus about its lower outer peripheral surface, is a water trough or sump 39 covered by a grill 40. The water trough 39 serves as a water reservoir herein, and appropriately is connected to a channel 41 which leads to a water pump 42. Attached to the water pump 42 and projecting vertically upwardly therefrom is a water transportation conduit 43. This conduit 43 projects horizontally once it reaches a point above the evaporator drum 11, and then downwardly once it reaches a point above the trunnion shaft 30 where it is attached thereto by means of a swivel type water distribution nipple 44. The nipple 44 is attached to water conduits 45 which lead to a generally annular or semi-circular perforated water distribution tube 46.

Specifically, and as can be seen in FIGS. 1 and 3, the water which is to be frozen upon the evaporator drum surface 11*a* is supplied from above through the generally semi-circular, perforated water distribution tube 46 which is attached by way of a system of conduits 45 to the trunnion shaft 30 for rotation about the periphery of the drum 11. The terminal ends of the tubing 46, indicated at 57 and 58, are plugged, as it is not the intent herein to provide a cascading sheet of water onto the rotary cutting assembly 34, but to supply such water to those areas of evaporator drum surface some distance from such cutter assembly, or to that surface of the evaporator drum other than that which is in close proximity to the cutter assembly.

Water delivered onto the freeze surface 11*a* through the distribution tube 46 is in excess of the freezing capacity of the drum. Such excess water cascades downwardly through the grill 40 into the water trough 39 and is ultimately directed into the channel 41 leading to the water pump.

As can readily be seen in FIG. 2, the sheet of ice formed on the evaporated surface also forms over the terminal ends of the radially projecting ridges 12. Such a formation, however, is ideal for the proper functioning of the rotating cutter assembly 34.

Disposed upon the spine of the cutter assembly are a plurality of cube sizer bits 47 and a plurality of cutter ridges 48, alternately arranged therealong.

As depicted in FIG. 3, there is minimal clearance between the terminal end of the ridges 48 of the cutter assembly 34 and the terminal ends of the ridges 12 disposed on the evaporator drum 11. This clearance between ridges 48 and 12 serves to separate the sheet of ice formed on the evaporator drum surface latitudinally, while the cube sizer bits 48 size and cut the sheet of ice longitudinally to form cubes.

Figure 5A:
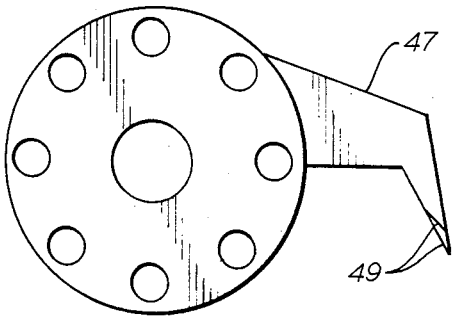
FIG. 5*a* is an exploded view of a cube sizer bit of the rotating cutter assembly constructed in accordance with the preferred embodiment of the present invention.
Figure 5B:
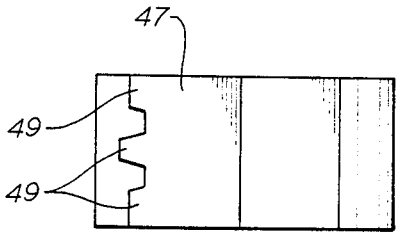
FIG. 5*b* is an exploded side view of a cube sizer bit of the rotating cutter assembly constructed in accordance with the preferred embodiment of the present invention.

The novel rotating cutter assembly 34 is provided with a plurality of cube sizer bits 47 which function in sequence to produce ice cubes. The construction of the blades or terminal ends 49 of the cube sizer bits 47 is shown in FIGS. 5*a* and 5*b*. As shown, each blade 49 is bevelled to produce a triple-blade configuration with the center blade projecting outwardly for a distance greater than that of the end blades. Advantageously, this configuration permits the center blade to penetrate a substantial distance into the ice, such penetration ending short of contact with the surface of the evaporator drum upon which the ice is formed. It will be observed that the sizer bits 47 are appropriately angled to facilitate entry of the blade 49 into the ice and deflection of the cube, once sized, from the surface of the evaporator drum. Further, the configurations of the sizer bar 47 and its appended blade 49 possess the advantages of sizing, breaking, and removing the ice in a continuous operation without the expenditure of excessive amounts of mechanical energy while making uniform ice cubes with higher production per BTU.

In operation, the cutter assembly 34 and water distribution tube 46 are continuously revolved about the freezing surface at a relatively low rate of speed by means of the motor means 28 coacting with the gear box 29, trunnion shaft 30, toothed circular drive gear 32, support bearings 33 and 35, bearing wheels 38, gear wheel 50 and 53, and chain 54. Invariably, the cube sizer bits 47 and bevelled blades 49 advance continuously and sequentially over the freezing surface, to remove sized ice cubes from the sheet of ice formed thereupon. Specifically, trunnion shaft 30 is energized through motor means 28 and imparts rotary movement to gear wheel 50. By means of chain 54 such rotary movement is transmitted to gear wheel 53 and ultimately to the rotating cutter assembly 34, the cube sizer bits 47 of such cutter assembly functioning in sequence to remove cubes of ice from the freezing surface 11*a*. It may be readily seen that the rotating cutter assembly 34 works in conjunction with the gear ratio of toothed circular drive gear 32 and gear wheels 50 and 53 to determine the size of the cubed ice, as well as the speed with which the cutter assembly 34 revolves about the evaporator drum.

Advantageously, the size, and thus, the ice producing capacity of the herein described icemaker may be varied by changing the size (height) of the evaporator, increasing or decreasing the number of cube sizer bits, and lengthening or shortening the spine upon which the sizer bits are disposed.

Water is delivered onto the freezing surface 11*a* at a predetermined rate from the water pump 42 through the perforated distribution tube 46. Simultaneously, refrigerant is circulated through the evaporator coils 15 so as to maintain the surface of the evaporator drum 11 at freezing temperature at all times. Excess water delivered to the freezing surface is directed through the grill 40 into the water trough 39 and channel 41 for redistribution to the freezing evaporator drum surface. The constantly advancing and sequentially deployed cube sizer bits 47 and cutter ridges 49 of the cutter assembly 34 act to continuously break, size and remove cubes of ice from the frozen sheet of ice covering the entire area of the freezing surface. The ice cubes removed from the evaporator surface hit the grill 40 covering the water trough 39 and fall into a storage bin (not shown) disposed beneath the icemaker 10.

While a particular embodiment of the present invention has been herein illustrated and described, it is not intended to limit the invention to such disclosure, as changes and modifications may be made therein and thereto.

It is to be understood that the present invention is not to be taken as being limited to the accopanying drawings and specification. It is also to be understood that the phraseology and terminology herein employed are for purposes of description and not of limitation, since the scope of the present invention is denoted by the appended claims.

What is claimed is:

1. An ice maker for automatically and continuously producing clear in cubes, comprising:

(a) a vertically disposed, stationary evaporator drum, the exterior surface of said evaporator drum including a plurality of radially outwardly projecting ridges, said exterior surface being chilled to a freezing temperature;

(b) a rotary, perforated water distribution tube overlying the outer circumferential surface of said evaporator drum for delivering a continuous and predetermined amount of water to said exterior surface so as to form a layer of ice thereupon;

(c) a water pump for supplying water to said rotary, perforated water distribution tube; and, (d) a rotary, sequentially functioning, cutter asssembly coacting with said rotary, perforated water distribution tube, said cutter assembly including a plurality of cube sizer bits which act to continuously and sequentially break, size and remove cubes from said layer of ice formed on said exterior freezing surface of said evaporator drum.

2. The ice maker as defined in claim 1, wherein said vertically disposed stationary evaporator drum has a triple-walled configuration inlcuding an interior wall, a middle wall, and an exterior wall.

3. The ice maker as defined in claim 2, wherein a plurality of tubular evaporator coils are disposed between the exterior wall and the middle wall of said triple-walled evaporator drum.

4. The ice maker as defined in claim 2, wherein a body of insulating material is disposed between the middle wall and the interior wall of said evaporator drum.

5. The ice maker as defined in claim 1, wherein a suitable motor means is disposed within the interior cavity of said evaporator drum, said motor means being connected to a gear box from which extends a trunnion shaft adapted to impart rotary movement through a chain to said rotary, sequentially functioning cutter assembly.

6. The ice maker as defined in claim 5, wherein said rotary, perforated water distribution tube is attached by way of a system of conduits to said trunnion shaft for rotation about the periphery of said evaporator drum.

7. The ice maker as defined in claim 1, wherein the terminal ends of said perforated water distribution tube are plugged so as to supply water to those areas of the evaporator drum surface other than that area occupied by the rotary sequentially functioning cutter assembly.

8. The ice maker as defined in claim 1, wherein a water transportation conduit serves to connect said water pump with a swivel-type water distribution nipple, said distribution nipple being connected to conduits leading to said perforated water distribution tube.

9. The ice maker as defined in claim 1, wherein said water pump is disposed within a water reservoir connected via a channel to a circular water trough.

10. The ice maker as defined in claim 1, wherein said plurality of cube sizer bits are bevelled to produce a triple blade configuration with the center blade projecting outwardly for a distance greater than that of the end blades.

11. The ice maker as defined in claim 1, wherein said cube sizer bits are appropriately angled to facilitate entry of the blades thereof into the ice and deflection of ice cubes from the surface of said evaporator drum.

12. The ice maker as defined in claim 1, wherein said rotary, sequentially functioning, cutter assembly and said water distribution tube are continuously revolved about the freezing surface of said evaporator drum at a relatively low rate of speed.

13. The ice maker as defined in claim 1, wherein said cube sizer bits of said rotary, sequentially functioning cutter assembly advance continuously and sequentially over the freezing surface of said evaporator drum to remove sized ice cubes from the sheet of ice formed thereupon.

* * * * *